United States Patent [19]

Grünig

[11] Patent Number: 4,989,715

[45] Date of Patent: Feb. 5, 1991

[54] METHOD AND DEVICE FOR DETECTING COINS

[75] Inventor: Dieter Grünig, Wohlen, Switzerland

[73] Assignee: Grünig Administration, Badger, Minn.

[21] Appl. No.: 235,325

[22] Filed: Aug. 22, 1988

[30] Foreign Application Priority Data

Dec. 31, 1987 [CH] Switzerland ..... 05124/87

[51] Int. Cl.[5] ..... G07D 5/00

[52] U.S. Cl. ..... 194/317; 453/3

[58] Field of Search ..... 194/303, 317; 453/3; 209/590; 73/163, 579

[56] References Cited

U.S. PATENT DOCUMENTS

| | | | |
|---|---|---|---|
| 3,012,649 | 12/1961 | White et al. | 194/317 |
| 3,939,953 | 2/1976 | Miyazawa | 194/317 |
| 4,342,229 | 8/1982 | Massa | 73/579 |

FOREIGN PATENT DOCUMENTS

| | | | |
|---|---|---|---|
| 0219574 | 4/1987 | European Pat. Off. | 194/317 |
| 2005038 | 8/1971 | Fed. Rep. of Germany | 73/579 |

*Primary Examiner*—F. J. Bartuska
*Attorney, Agent, or Firm*—Michael J. Striker

[57] ABSTRACT

A method and a detector for controlling coins inserted into a slot of a device are disclosed, in which a device for imparting oscillations to a coin is arranged, The frequency of oscillations is measured and compared with a predetermined value in an electronic device which actuates a coin separating device which guides unsuitable coins into a separation passage.

6 Claims, 1 Drawing Sheet

METHOD AND DEVICE FOR DETECTING COINS

BACKGROUND OF THE INVENTION

The present invention relates to a method for the electronical detection of coins and separation of suitable coins from unsuitable coins and a coin detector for carrying out the method.

In automate provided with coin insertion slots false coins or non-impressed metal plates can be easily inserted into the slots in place of suitable coins. A coarse coin detection is already carried out by selection of the size of the insertion slot. This type of detection however is not effective when coins of various sizes can be used and therefore the slot has to be made for the largest coins. In order to prevent the reaction of the automate when non-allowed coins are inserted thereinto various detection devices have been developed in which a specific suitable property or size of the coin served as a criterium. Moreover, none of conventional devices of the foregoing type are reliable to prevent any false detection results with the result that good or suitable coins as well as false coins were accepted by the device. An induction-type detection has proved to be most efficient hitherto but such a detection is not always sufficient.

SUMMARY OF THE INVENTION

It is an object of the present invention to provide an improved method and a device for detecting coins and separating suitable coins from unsuitable ones.

It is another object of this invention to provide a simple and reliable method of separating non-suitable coins from correct coins.

These and other objects of the invention are attained by a method for an electric detection of coins for separating non-suitable coins from suitable coins for devices with coin insertion slots, the method comprising the steps of imparting oscillations to coins inserted into a slot and, while freely falling in a device, electronically measuring the frequency of said oscillations, and separating coins when a measured frequency of said oscillations deviates from a predeterminable correct value beyond a selected allowable tolerance limit.

The oscillation-imparting step may be carried out either by knocking at a coin or striking the coin against a part in the device.

The objects of the invention are also attained by an electronic coin detector for the detection of coins for separating non-suitable coins from suitable coins for a device with a coin insertion slot, the detector comprising means for imparting oscillations to coins inserted into a slot and freely falling in said device; means for electronically measuring the frequency of said oscillations while free falling; and means for separating coins when the measured frequency of said oscillations deviates from a predeterminable correct value beyond a selected allowable tolerance limit.

The measuring means may include a microphone and an electronics which receives a frequency-responsive signal from said microphone, said separating means including a separating passage in said device, which receives non-suitable coins, and means to guide said non-suitable coins into said passage, said guide means being actuated by said electronics.

The novel idea of the invention is that the sound or frequency measurements of the oscillating coins provides for a reliable control or detection of coins. Since oscillations imparted to the coin by knocking or striking, depend on such properties of the coin as its weight, thickness, size, material, stamping, etc. it is possible for each individual case to empirically determine a permissible correct value and a respective narrow tolerance range for this value and to separate a coin as non-suitable when such a range is exceeded. This results in a very high degree of reliability of the coin detection. In case of failure of any of the structural components all the coins fall into the separating passage, whereby for example an automate is easily put out of operation and thus secured against the illegal removal of goods.

The imparting means may include an anvil provided in said device, a coin striking against said anvil, whereby oscillations are imparted to the coin.

The device may include an inclined plane on which the coin inserted into said slot rolls, and in this way oscillations are imparted to said coin by a hammer knocking at said coin.

A number of identical or similar coin detectors provided with oscillation-imparting means of this invention may be employed simultaneously.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
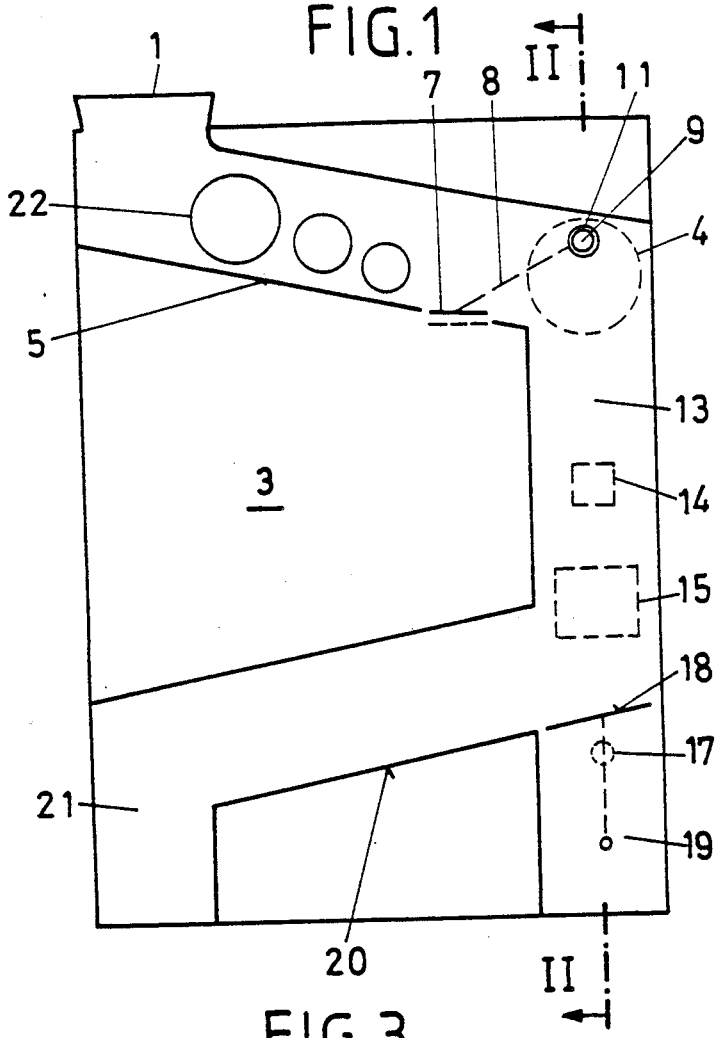
FIG. 1 is a side view of a coin detector with a removed side wall, acting by a knock at the coin.
Figure 2:
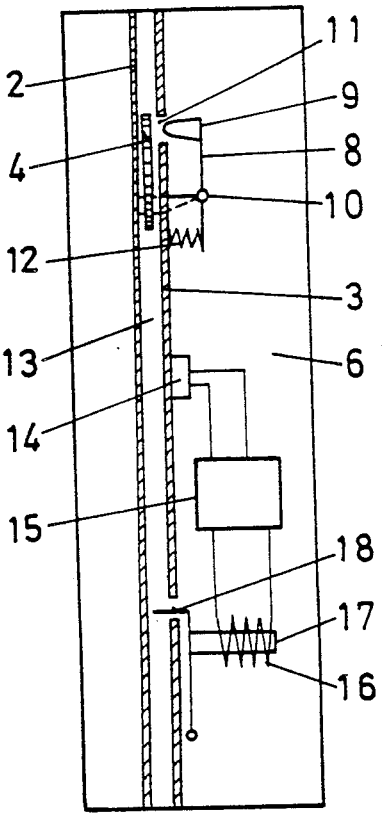
FIG. 2 is a sectional view taken along line II—II of FIG. 1.

Referring now to the drawings in detail, and firstly to FIGS. 1 and 2, it will be seen that a coin detector has an insertion slot 1 for a coin 4 rolls which further is guided between parallel side walls 2 and 3 rolling on an inclined plane 5. Side walls 2 and 3 are secured to plate 6. In its path between walls 2 and 3, coin 4 rolls over a tilting table or rocker 7 which yields under gravity and thereby acts via a lever 8 on a hammer 9 which is swingably or pivotally supported on a pivot 10. Due to the motion of the tilting table 7, hammer 9 knocks at the flat surface of the coin 4 through an opening 11 in the side walls 3 so that oscillations are imparted to the coin 4 by the hammer. The latter is moved back to its inoperative position by a spring 12.

The coin then freely falls through a chute 13 formed between said two parallel side walls 2 and 3. Coin 4 while falling down passes a microphone 14 which detects the frequency of oscillations of the coin and supplies a respective signal corresponding to that frequency to an electronics 15 which is of any conventional suitable type. If the value of the detected frequency lies within an allowed selected tolerance range of a predetermined correct value stored in the electronics 15 the latter actuates a magnet coil 16, and a magnet core 17 will be pulled away from the side wall 3 whereby a sorting or separating deflector 18 connected to magnet core 17 will open a chute 19 to the intermediate safe or cashier box.

If, with a sound-dependent measurement by the microphone 14, the value lies outside the given tolerance range the chute 19 remains closed and the coin rolls over an oblique plane 20 to the separating passage 21.

If the coin detector must be capable of examining various kinds of coins, especially of various sizes, their oscillation frequencies would strongly differ from each other. Therefore an induction detector 22 is provided. The induction detector or sensor 22 senses the size of the rolling coin and supply the electronics 15 with a respective signal in order to adjust the electronics 15 to a correct value for the sound ranging in dependence on the coin size.

If the microphone 14 or electronics 15 are defective no signal or pulse is furnished to the magnet coil 16, the chute 19 remains closed and all the inserted coins fall into the separating passage 21 whereby an illegal product removal is prevented.

Figure 3:
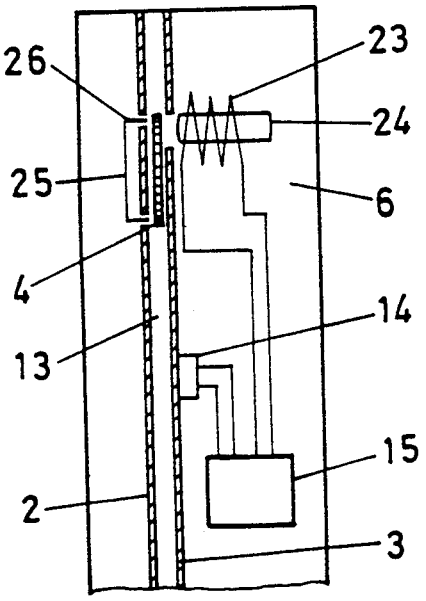
FIG. 3 is a view similar to that of FIG. 2, of another embodiment.

FIG. 3 illustrates a sectional view of a device of this invention with an electromagnetically produced knock at the coin. Acted by the rolling coin, the electronics 15 sends a signal to the magnet coil 23 which pulls the, magnet core 24 acting as a hammer that knocks at the flat surface of the coin 4 to impart to the latter oscillations. The following process is the same as that described for the embodiment of FIGS. 1 and 2.

As further seen from FIG. 3, in order to support the coin against the knock of the magnet core 24 a counter holder 25 is provided. Three pins 26 of the counter holder 25, which are returnable to the non-operative position, penetrate the side wall 2 of the device. Simultaneously with the movement of the magnet core 24, the counter holder 25 which is formed as an arm bracket is moved in the opposite direction, and pins 26 advance out of the wall towards the coin to support the same against the knock of the magnet core. Such a supporting of the coin can be, of course, applied to the embodiment of FIG. 2. Also, hammer 9 can be formed as an electromagnetic element in FIG. 2, similar to the magnet core 24 of FIG. 3.

Figure 4:
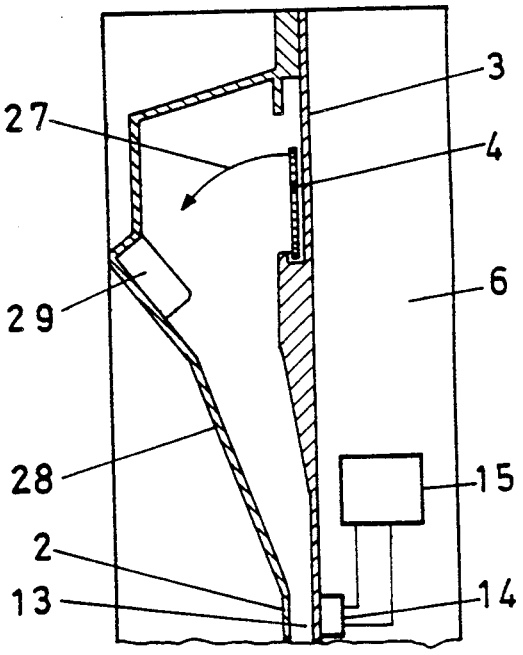
FIG. 4 is a view similar to that of FIG. 2 of a coin detector of yet another embodiment, acting by striking the coin against an anvil.

FIG. 4 shows a further embodiment of the coin detector. In this embodiment, the coin at the end of its rolling path tilts laterally as shown by arrow 27. This can be obtained by a very simple constructive means, which with an inclined mounting of the detector would be further simplified. The upper portion 28 of the side wall 2 is formed as an upwardly widening inclined wall and serves the purpose of supporting an anvil or plate 29. If now coin 4, firstly supported at the bottom side of a widened portion of side wall 3, as shown in FIG. 4, tilts down in the direction of arrow 27 the coin strikes against the anvil 29 and begins to oscillate. A further process of the coin detection is carried out in the same fashion as that described for the embodiments of FIGS. 2 and 3.

The imparting of oscillations to the coin can be performed also in another fashion. In many cases, for example it is sufficient that the coins being detected strike against a wall of the device at the end of their rolling path between the side walls 2 and 3 in order to make the coins oscillate.

It is also to be noted that the coin detector is used preferably for automates, but could also be used for other purposes, for example for coins sorting in banks. A number of coin detectors, placed one after another and adjusted to different oscillation frequencies and assembled into a single unit can be also utilized.

It will be understood that each of the elements described above, or two or more together, may also find a useful application in other types of coin detectors differing from the types described above.

While the invention has been illustrated and described as embodied in a coin detector, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. Method of electronic detection of coins for separating non-suitable coins from suitable coins, said method comprising the steps of imparting oscillation to the coins with a knock on a flat side surface of a coin; measuring a frequency of the imparted oscillation during subsequent free fall of the coin; and separating the coin when the measuring frequency characterizing the suitability of the coin, deviates from a nominal frequency beyond a predetermined tolerance limit.

2. An electronic coin detector for separating non-suitable coins from suitable coins, said coin detector comprising an insertion slot through which the coins fall; means for imparting oscillation to the coins with a knock on a flat side surface of a coin; microphone means for measuring a frequency of the oscillation imparted to the coin, during free fall of the coin; and electronic means for detecting a measuring value generated by said microphone means and for effecting separation of non-suitable coins when the measuring value deviates from a nominal value beyond a pre-determined tolerance limit.

3. The detector as defined in claim 2, further comprising means for separating non-suitable coins and including a separating passage and means for guiding the non-suitable coins into said separating passage and actuatable by said electronic means.

4. The detector as defined in claim 2, wherein said oscillation imparting means includes one of mechanical and electromagnetic means.

5. The detector as defined in claim 3, wherein in case of failure of at least one of said microphone and said electronics all the coins being detected flow into said separating passage.

6. The detector as defined in claim 2, wherein at least one additional coin detector is provided.

* * * * *